US007963662B2

(12) United States Patent
Chung et al.

(10) Patent No.: US 7,963,662 B2
(45) **Date of Patent: *Jun. 21, 2011**

(54) RECESSED SEALED LIGHTING FIXTURE

(75) Inventors: Casey Chung, Bloomingdale, IL (US); Jill Cody, Milwaukee, WI (US); Brandon Stolte, Lindenhurst, IL (US); Marcelino Pena, Chicago, IL (US); Michael Thornton, Chicago, IL (US)

(73) Assignee: Focal Point, L.L.C., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/688,441

(22) Filed: Jan. 15, 2010

(65) Prior Publication Data

US 2010/0118525 A1 May 13, 2010

Related U.S. Application Data

(63) Continuation of application No. 11/099,223, filed on Apr. 5, 2005, now Pat. No. 7,674,005.

(60) Provisional application No. 60/592,509, filed on Jul. 29, 2004.

(51) Int. Cl.

| | |
|---|---|
| ***F21S 8/00*** | (2006.01) |
| ***F21S 4/00*** | (2006.01) |
| ***F21V 1/00*** | (2006.01) |
| ***F21V 5/00*** | (2006.01) |
| ***F21V 7/00*** | (2006.01) |
| ***F21V 21/00*** | (2006.01) |

(52) U.S. Cl. ... 362/223; 362/147; 362/225; 362/217.05; 362/217.09; 362/217.12; 362/217.16

(58) Field of Classification Search ..... 362/223
See application file for complete search history.

(56) References Cited

U.S. PATENT DOCUMENTS

| | | | | |
|---|---|---|---|---|
| 4,086,480 | A * | 4/1978 | Lahm | 362/148 |
| 4,580,200 | A * | 4/1986 | Hess et al. | 362/223 |
| 6,508,567 | B1 * | 1/2003 | Fiene | 362/147 |
| 7,261,435 | B2 * | 8/2007 | Gould et al. | 362/223 |
| 7,530,716 | B2 * | 5/2009 | Mayfield et al. | 362/299 |
| 2005/0073838 | A1 * | 4/2005 | Haugaard et al. | 362/225 |

* cited by examiner

*Primary Examiner* — Jong-Suk (James) Lee
*Assistant Examiner* — David J Makiya
(74) *Attorney, Agent, or Firm* — Banner & Witcoff, Ltd.

(57) ABSTRACT

In an embodiment, a recessed light fixture includes a structural reflector and two end caps that form a light fixture housing. A first, second and third optics areas are provided. At least one first light source type is mounted near the first optics area. A second light source type is mounted near the second optics area and the second light source type is mounted near the third optics areas, the second light source type having a light output level substantially lower than the light output level of the first light source type. A diffuser is configured to sealably mount to the light fixture housing so as to substantially seal an interior portion of the light fixture. In operation, the light fixture can be switch between an ambient mode and an examination mode while providing a cost effective and attractive design.

22 Claims, 13 Drawing Sheets

RECESSED SEALED LIGHTING FIXTURE

This application is a continuation of U.S. patent application Ser. No. 11/099,223, filed Apr. 5, 2005, which claims priority benefits based on U.S. Provisional Application No. 60/592,509 filed Jul. 29, 2004. Both applications are entirely incorporated herein by reference.

BACKGROUND OF THE INVENTION

1. Field of the Invention

The present invention relates to recessed light fixtures, more specifically to recessed light fixtures for use in medical facilities.

2. Description of Related Art

Recessed light fixtures are known, and are typically used when it is desirable to minimize the projection of the light fixture below the ceiling surface. Recessed light fixtures, as opposed to light fixtures that substantially extend below the ceiling surface, tend to be more aesthetically appealing and provide a cleaner look when installed. Thus, recessed light fixtures tend to be used in commercial settings such as offices and the like.

Some recessed light fixtures use a curved reflective surface mounted in a rectangular shaped housing. The light source or sources is/are mounted inside the housing near the curved surface and some type of diffuser is mounted below the light source so as to minimize the harsh effects of direct light. A common type of diffuser is a perforated shield. The combination of the diffuser and the curved reflective surface allow the light to exit the fixture in a more controlled and even manner so as to prevent unsightly bright or dark spots.

Another type of light fixture is a sealed light fixture for use in high abuse settings. Such sealed light fixtures are typically used in heavy commercial or industrial settings where the environment can be abusive to unsealed light fixtures because of moisture, dust and the like. These sealed fixtures tend to have a rectangular housing that is coupled to a plastic or glass diffuser. The diffuser is sealed along its edges to the fixture so that the light source and the internal components are protected from the surrounding environment. While functional, these light fixtures suffer from being relatively less attractive. Due to various constraints and different design considerations, the sealed light fixtures used in high abuse environments are designed so that the entire fixture extends below the ceiling and thus are more commonly used in situations where the ceiling is relatively high.

A second type of sealed fixture is used in a clean room setting. Clean rooms require a minimum amount of dirt and particles in the air and typically are kept clean via a laminar air flow that runs from the ceiling down to the floor. Light fixtures for use in clean rooms can be installed in the ceiling and often include a rectangular housing with a flange around the edge housing. The clean room light fixtures are recessed into the ceiling and sealed to the ceiling between the flange and the ceiling. A second seal is than provided between a plastic diffuser and the light fixture housing so that internal portion of the light fixture is sealed from the inside of the clean room. To avoid turbulence that allows the collection of dust or particles, these light fixtures use a flat diffuser that is close to flush with ceiling.

While the various light fixtures described above are effective in their respective environments, they are less suitable for use in a medical facility. What is needed is a light fixture that can provide some of the benefits provided by the above fixtures in a more aesthetically pleasing package while minimizing the cost of the fixture.

BRIEF SUMMARY OF THE INVENTION

In an embodiment of the present invention, a light fixture is provided that has a concave-shaped structural reflector that also acts as the fixture enclosure. Two end caps are welded to the structural reflector so that the combination of the end caps and the structural reflector forms a rectangular like opening. Inside the opening a reflector is positioned longitudinally along the center of the rectangular opening. The reflector has a first optics area and a second optics area and a third optics area. Two high output linear light sources are mounted adjacent the first optics area. A first lower output linear light source is mounted adjacent the second optics area and a second lower output linear light source is mounted adjacent the third optics area. A curved diffuser is sealably mounted to the structural reflector so as to substantially seal the interior portion of the light fixture from dust accumulation. Preferably the curved diffuser has a smooth exterior surface so as to minimize dust and bacteria collection on the exterior surface and to facilitate easy cleaning of the diffuser.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

Light fixtures for use in medical facilities have requirements somewhat different than the requirements of a typical office. The requirements are even more unique when the light fixture is installed directly above the patient in a hospital room. In such a circumstance it is desirable that the light fixture provide an attractive appearance but be easy to clean so as to avoid or at least minimize the accumulation of dust and germs. In addition, it is desirable to have a light fixture that has at least two modes of operation, an ambient mode and an examination mode.

Figure 1:
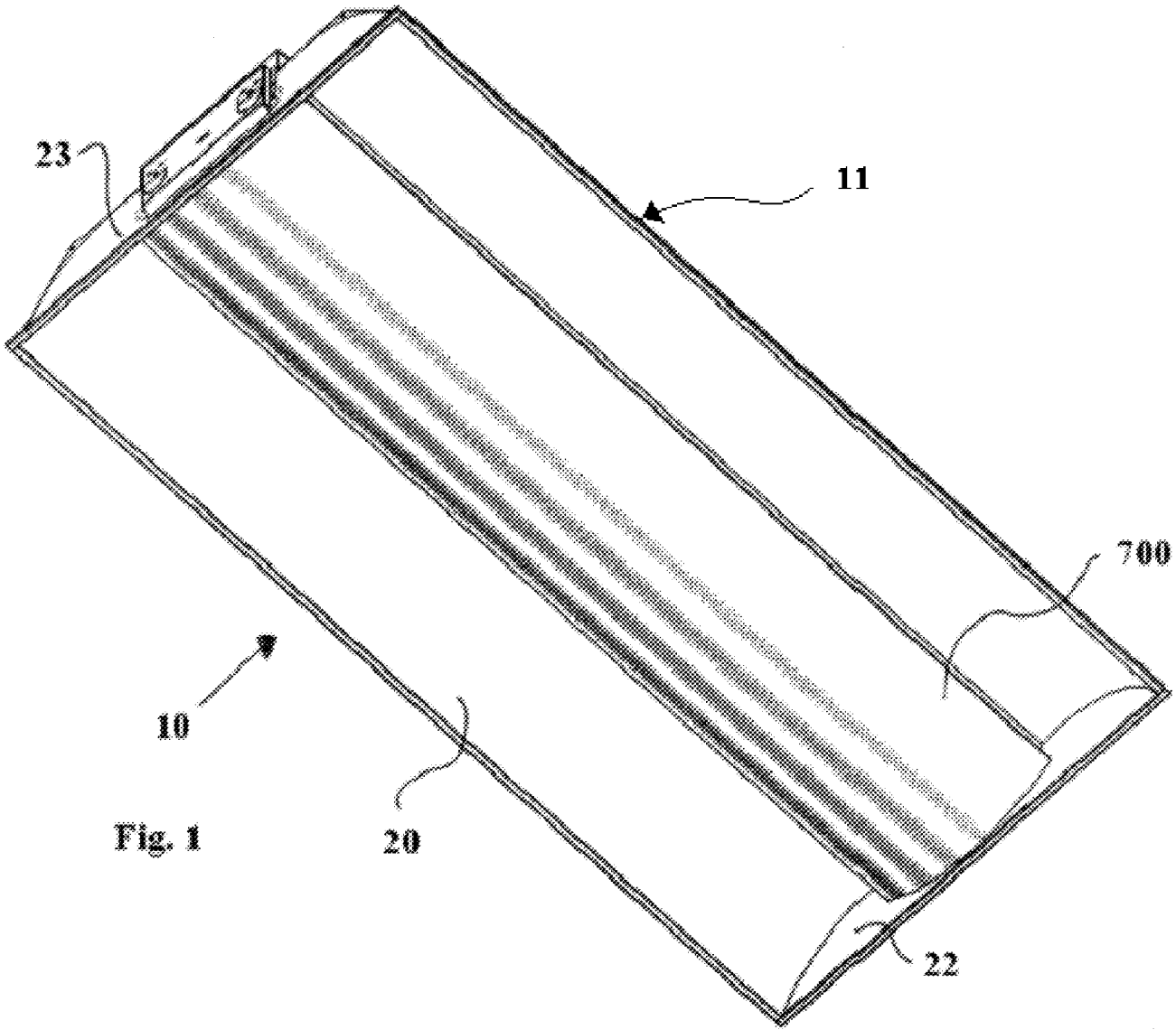
FIG. 1 is an illustration of an isometric view of an embodiment of the assembled light fixture.

FIG. 1 is an illustration of an exemplary embodiment of a sealed light fixture 10. As depicted, the light fixture 10 comprises a structural reflector 20, an end cap 22, an end cap 23 and a diffuser 700. A light fixture housing 11 includes the structural reflector 20, the end cap 22 and the end cap 23. The preferred construction, as described below, provides an aesthetically pleasing light fixture that is capable of providing excellent functionality while reducing manufacturing costs. Thus, the preferred embodiment provides numerous advantages over fixtures of the prior art.

The structural reflector 20 and the end caps 22 and 23 are preferably die-formed out of a 20 gauge cold rolled steel alloy. The light fixture housing 11, once assembled, is preferably coated with a white reflective paint so as to provide a high level of reflectivity. In an embodiment, the coating is a polyester powder coat applied over a 5-stage process and the coating preferably has a reflectance of 94% or more.

In an embodiment, the diffuser 700 consists of a frosted acrylic configured to minimize visibility of the underlying linear light sources while maximizing the efficiency of the light fixture. For example, the diffuser could be made of an extruded, low brightness, DR acrylic.

Figure 2:
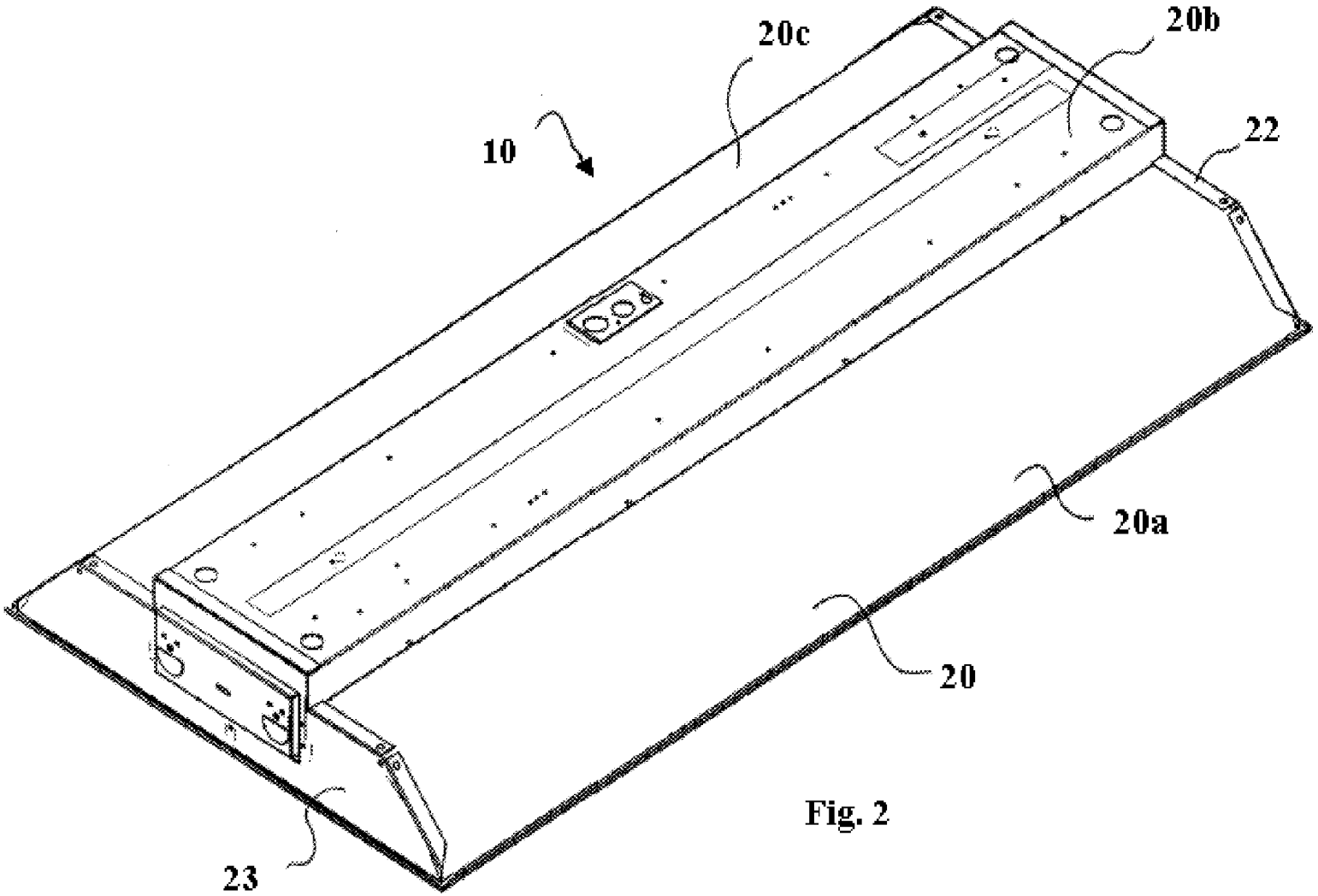
FIG. 2 is an illustration of an isometric view of the light fixture shown in FIG. 1 from an angle approximately opposite the angle of view of FIG. 1.

FIG. 2 is an illustration of the embodiment depicted in FIG. 1 from the opposite direction, thus depicting the backside of the light fixture 10. As depicted, the structural reflector 20 is a single piece having a curved side 20*a*, a square portion 20*b* and a curved side 20*c*. Thus, as depicted the structural reflector 20 is stamped out of a single sheet of steel. The end caps 22 and 23 are configured to mate with the ends of the structural reflector 20 so as to provide the fixture enclosure. As can be readily discerned from FIG. 2, the square portion 20*b* is not required to actually be square in shape. In a preferred embodiment as shown, the square portion 20*b* is rectangular in shape and as discussed below, provides a place for mounting the optical reflector.

As can be appreciated, various known electrical components typically used in a linear light source fixture are required. These components are known in the art and, therefore, further discussion regarding the various electrical components is not required. The housing 11 may additionally include one or more holes suitable for the purpose of either accepting wires and/or for allowing various electrical components to be installed within or connected (either directly or indirectly) to the housing in a known manner.

Figure 3:
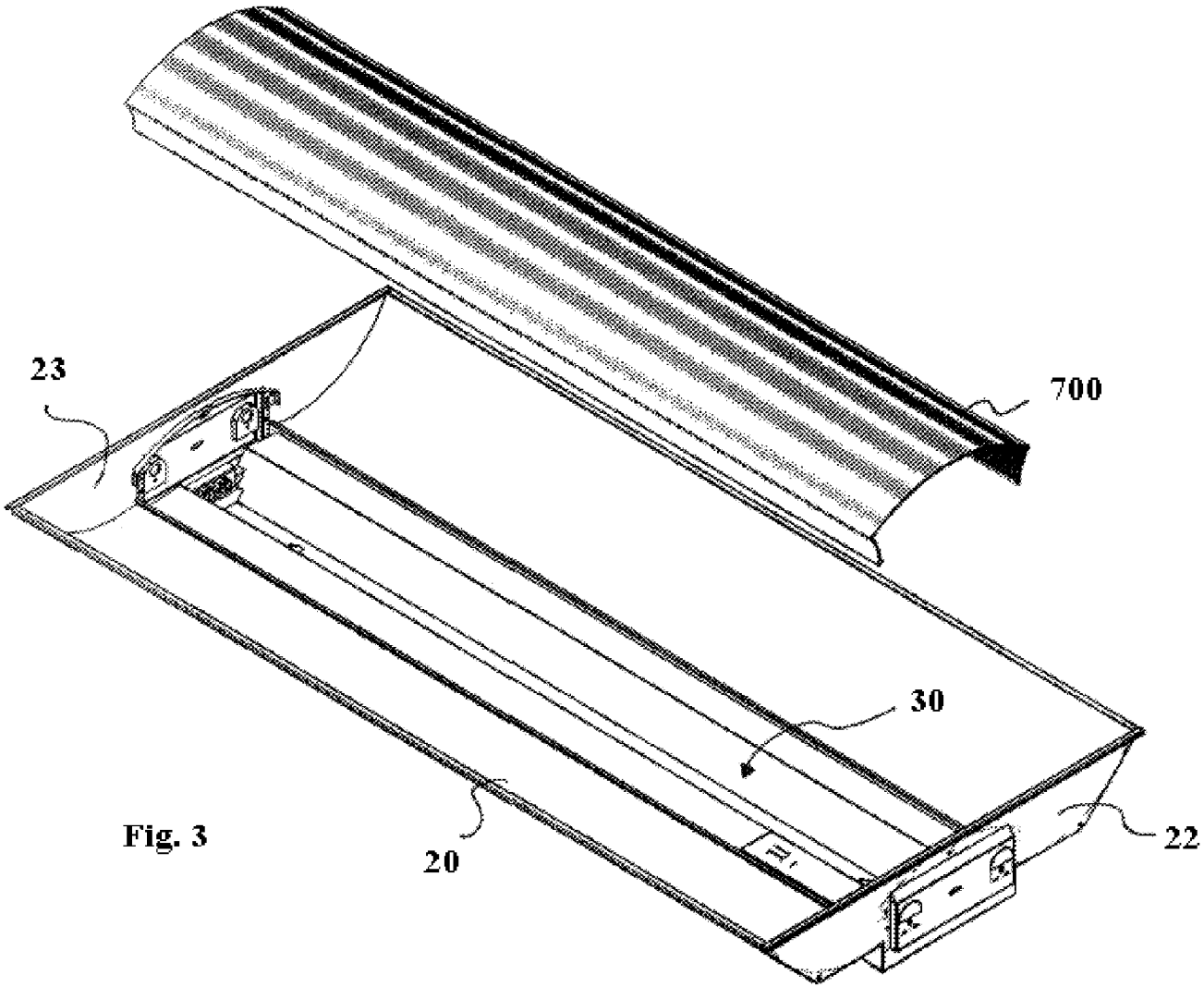
FIG. 3 is an illustration of a partially exploded isometric view of the light fixture shown in FIG. 1.

FIG. 3 depicts an partially exploded view of an embodiment depicted in FIG. 1, including the structural reflector 20, the end caps 22 and 23 and the diffuser 700. As depicted, an optical reflector 30 is positioned along the longitudinal centerline of the light fixture 10. Optical reflector 30 is preferably die formed and can be formed out of the same cold rolled steel used for making the structural reflector 20. Like the structural reflector, the optical reflector can be coated with a polyester powder coating applied via a 5-stage process. Preferably all the steel components are so coated so as to provide high levels of reflectivity and to ensure the fixture is corrosion resistant.

As can be noted, the end caps 22 and 23 are preferably attached to the structural reflector 20 so that there is little or no gap between the end caps 22 and 23 and the structural reflector 20. Preferably the end caps 22 and 23 are welded to the structural reflector 20 so as to minimize any gap between the structural reflector 20 and the end caps 22 and 23. The minimizing of the gap between the end caps 22 and 23 and the structural reflector 20 has the benefit of reducing the visibility of dark lines within the fixture that might otherwise make the fixture appearance undesirable and/or unacceptable. Additionally, welding the end caps 22 and 23 to the structural reflector 20 can provide additional structural rigidity.

Figure 4:
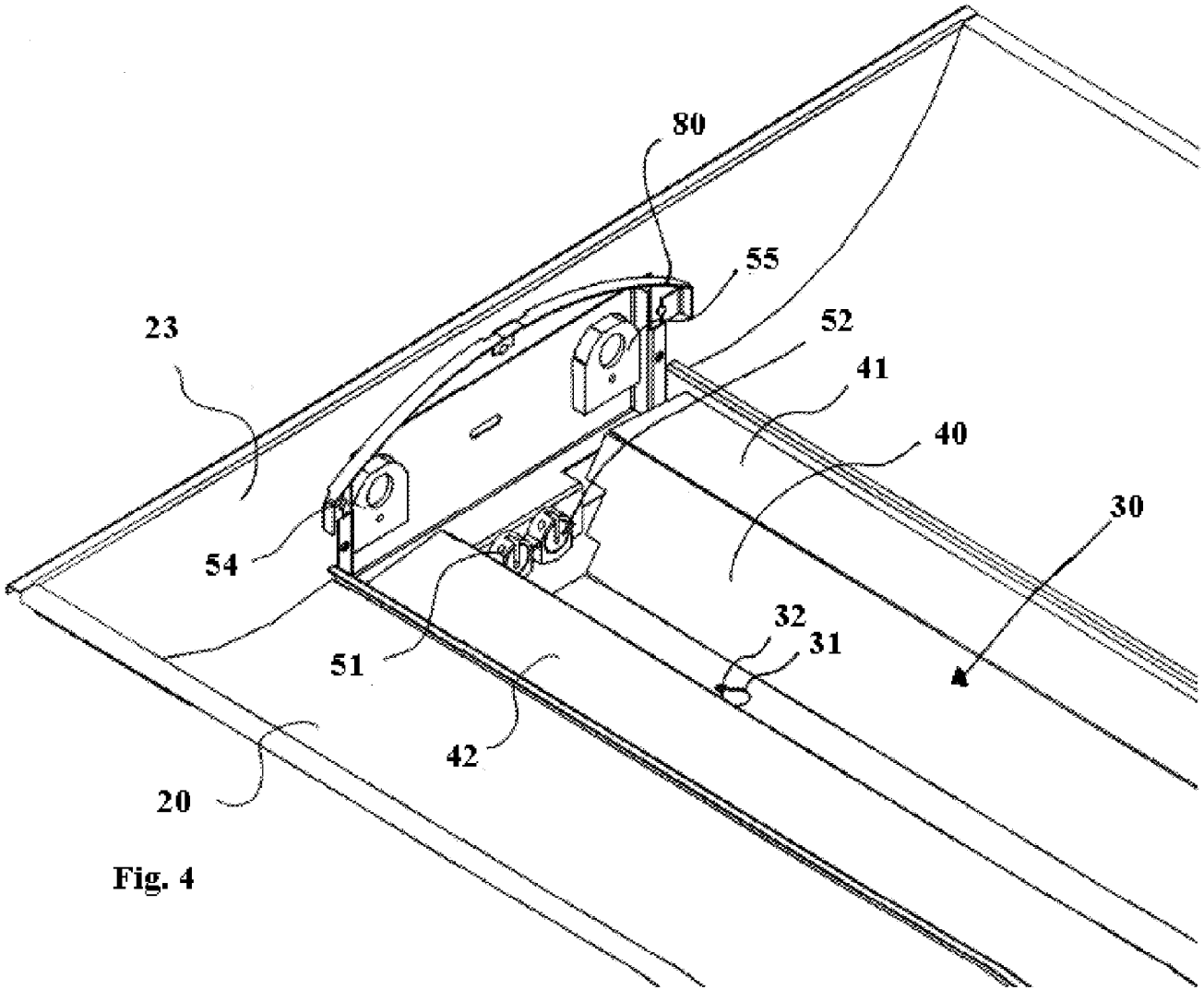
FIG. 4 is an illustration of an isometric view of an end of the light fixture shown in FIG. 3.

FIG. 4 illustrates a close-up isometric view of the embodiment depicted in FIG. 3. As depicted, the optical reflector 30 is mounted to structural reflector 20 via a hole 31 and a fastener 32. As can be appreciated, the hole 31 has a wider opening on one end than the other. Thus, in operation the wide end of the hole 31 is installed over the head of the fastener 32. The optical reflector 30 is then shifted until in the desired position. The fastener 32 can than be tightened so as to hold the optical reflector 30 in the desired position relative to the structural reflector 20. Preferably, a plurality of holes 31 and fasteners 32 are used to secure the optical reflector 30 to the structural reflector 20.

As depicted, the optical reflector 30 has a first optics area 40, a second optics area 41 and a third optics area 42. As depicted, optics area 40 is has three sides that provide a channel like appearance. In an exemplary embodiment, the light fixture is configured to accept two high output linear light sources such as a T5 high output bulb in lamp holders 51 and 52. Thus, in an exemplary embodiment, the primary function of the first optics area 40 is configured to provide reflectivity for the high output linear light sources. In such an exemplary embodiment, the lamp holders 54 and 55 can be configured to accept T8 bulbs. Thus, in such an exemplary embodiment, the primary function of the optics areas 41 and 42 are to provide reflectivity for the T8 bulbs installed in lamp holders 54 and 55. Typically, lamp holders are placed on both ends of a light source such as a T5 or T8 bulb. Thus, it is contemplated that a lamp holder corresponding to each of the lamp holders 51, 52, 54 and 55 may be included on the opposite end of the light fixture so that in operation the light sources can be securely installed and an electrical circuit is formed. In other words, the use of pairs of lamp holders is contemplated and can allow the lamp to be mounted on the light fixture housing 11 (FIG. 1).

As can be appreciated, the use of a T5 high output bulb can be advantageous because of the relatively high light output levels of a T5 high output bulb as compared to more commonly used bulbs having lower levels of light output. In an exemplary embodiment, the use of two T5 high output bulbs in combination with two T8 bulbs provides sufficient illumination such that a physician can readily examine the patient. In such an embodiment there is little need for additional illumination, thus the physician typically will not have to use additional light sources during the examination.

Thus, a potential advantage of a preferred embodiment of the present invention is to provide sufficient light in the examination mode so as to eliminate secondary light sources. The reduction of secondary light sources has an obvious cost benefit. In addition, reducing the need for secondary light sources can be advantageous because there is typically limited space inside a patient's room, thus eliminating the need for secondary light fixtures can reduce the clutter and typically results in a more aesthetically pleasing environment for the patient. Naturally, a pleasing environment tends to aid in patient morale and can even improve patient recover time due to the positive psychological effects that a pleasing environment brings.

As depicted in FIG. 4, a bracket 80 is mounted to the end cap 23. The bracket 80 provides a surface for use in installing and sealing the diffuser 700 in a manner that will be described in further detail below.

Figure 5A:
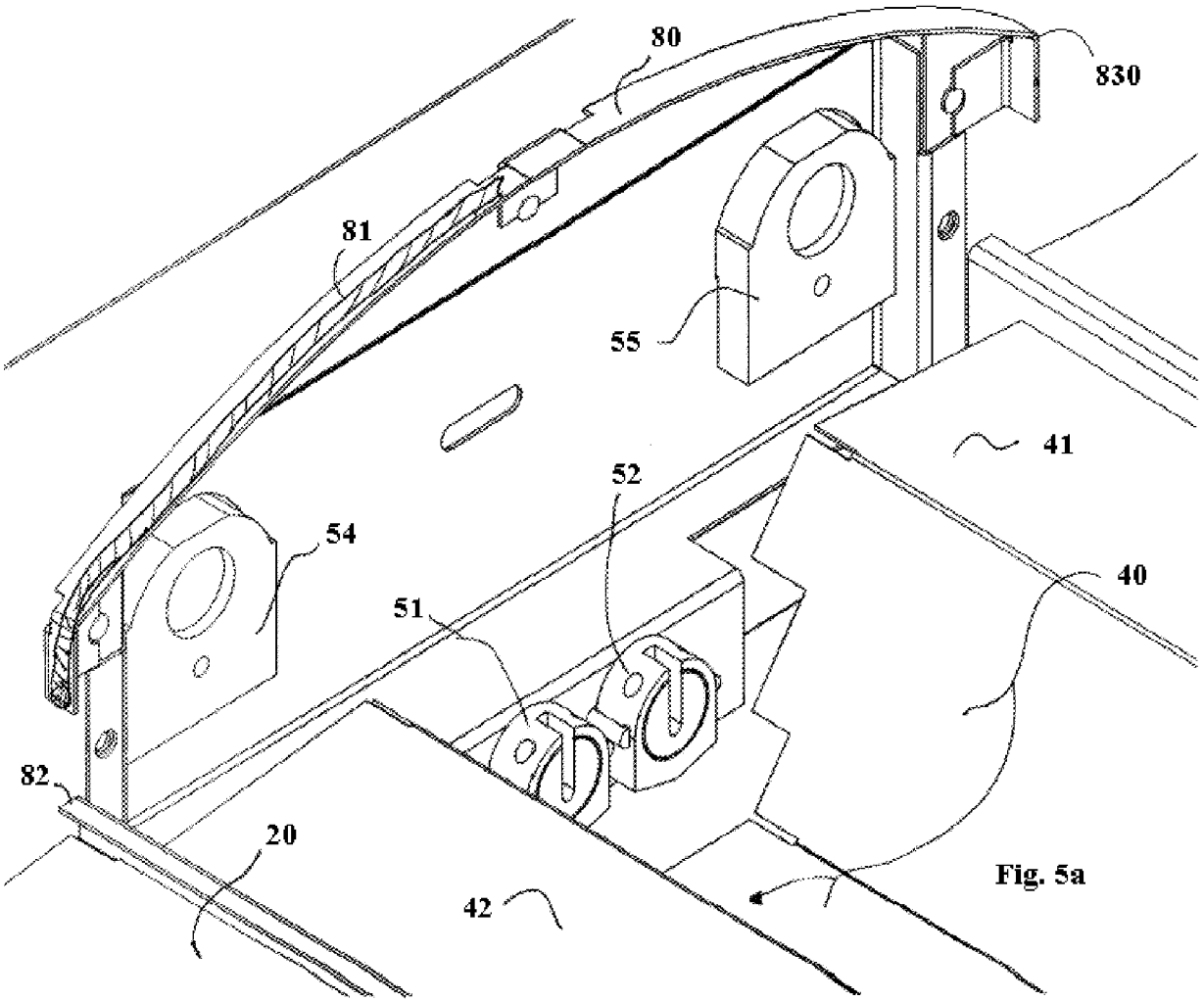
FIG. 5*a* is an illustration of a cutaway isometric view of the light fixture depicted in FIG. 4.

FIG. 5*a* illustrates a further close-up view of the light fixture depicted in FIG. 4. It should be noted that it is preferable to configure the light fixture such that the lamp holders 51 and 52 are symmetrical about, and close to, the center of the optics area 40. As can be appreciated from FIG. 5*a*, optics area 40 includes three surfaces, one of which is hidden by the isometric viewpoint, which in operation forms a channel around the linear light sources when the light sources are installed. Depending on the configuration of optics area 40, the distance between the light sources installed in lamp holders 51 and 52 may be varied so as to improve light reflection characteristics.

It should be further noted that while FIG. 5*a* depicts the location of the lamp holders 54 and 55 as skewed somewhat in comparison to the respective optics areas 42 and 41, it is preferable to configure the light fixture such that the lamp holders 54 and 55 are located approximate the optics areas 42 and 41, respectively, so that the relative positions of the lamp holders to the respective optics areas are symmetric about the center of the light fixture. In an embodiment, the position of the lamp holders 54 and 55 will be configured to allow light sources, when installed, to be centered about the optics areas 42 and 41, respectively.

A seal 81 is mounted on the bracket 80. For purposes of illustration the seal only extends along a portion of the mounting surface of the bracket 80. Preferably, however, the seal extends along most if not all of the entire surface of the bracket 80.

A rail 82 is mounted to the structural reflector 20 and preferably extends the longitudinal length of the light fixture. As depicted, there is a gap depicted between the rail 82 and the bracket 80. While it is preferable to minimize such gaps so as to maximize the sealing of the light fixture, such a gap may be useful to aid in the installation and removal of light bulbs in the fixture. As will be apparent to one of skill in the art, eliminating the gap requires a sufficient room to angle the light source so as to enable installation. Even with the gap it can be appreciated that the sealing is sufficient to substantially reduce the accumulation of dust and bacteria on an interior portion of the light fixture, the interior portion being the components and surfaces protected by the diffuser. As can be further appreciated, the rail 82 is approximate the optics area 42, thus, as depicted, the rail 82 is approximate the square portion 20*b* (FIG. 2).

Figure 5B:
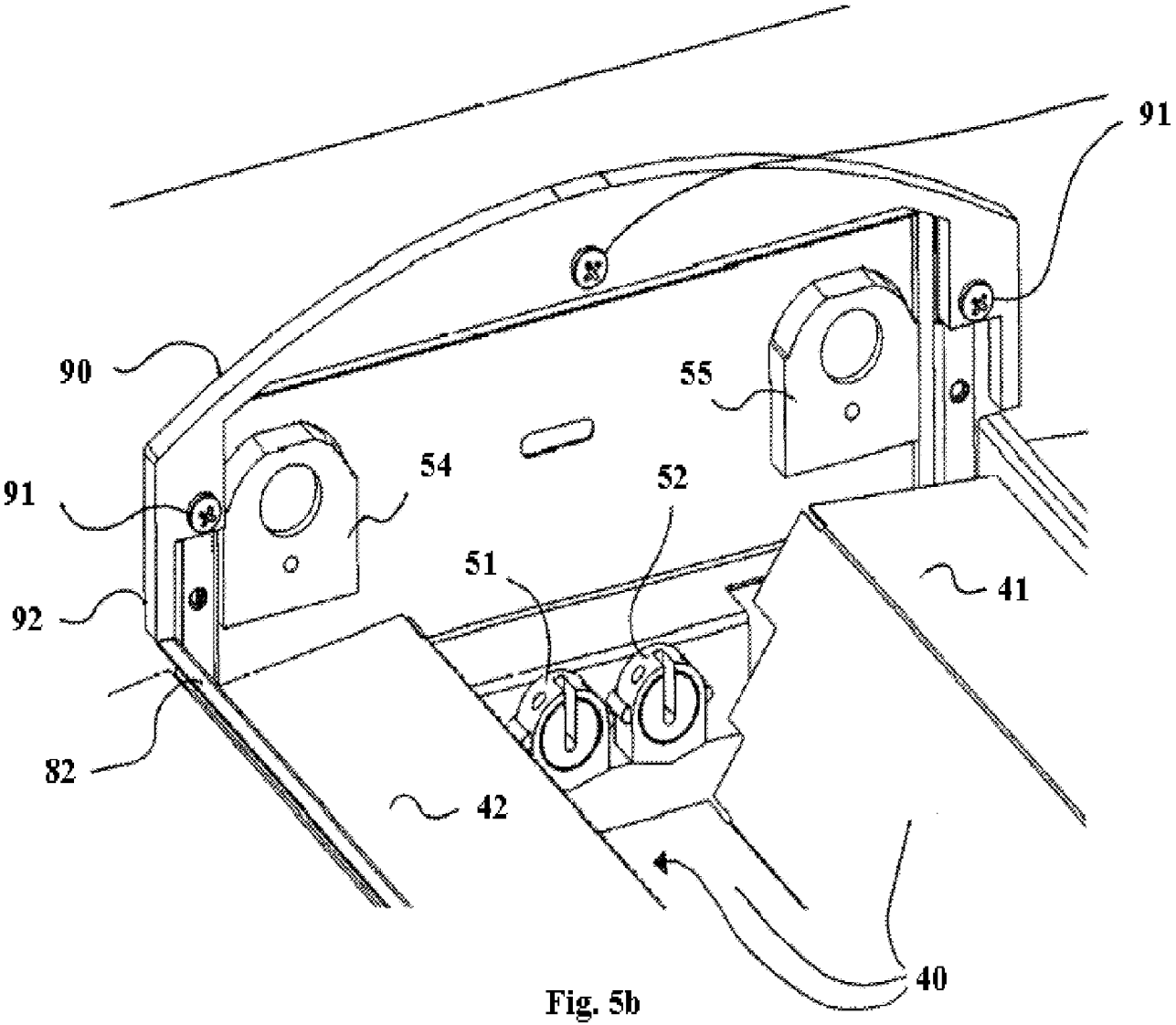
FIG. 5*b* is an illustration of an alternative embodiment of the light fixture depicted in FIG. 5*a*.

Turning to FIG. 5*b*, an alternative embodiment of the light fixture shown in FIG. 5*a* is provided. Bracket 80 and seal 81 are replaced with a gasket 90. The gasket 90 can be die cut and can be made of any suitable elastomeric plastic-like or rubber-like substance. As depicted, the gasket 90 is mounted via a plurality of fasteners 91. Naturally, the gasket 90 could also be mounted in any other well known matter such as through the use of adhesives or some other type of known fastening method. Preferably the gasket 90 will be configured so as to allow installation of light sources while still providing ample sealing of the interior portion of the light fixture. For example, as depicted the gasket 90 includes a finger 92 that extends down toward, and potentially even makes contact with the rail 82. Thus, the gasket 90 and the rail 82 may be linked. In this manner, the interior portion can be more effectively sealed against the accumulation of dust and bacteria and the like. Therefore, an end cap seal could consist of the gasket 90, the bracket 80 in combination with the seal 81, or other suitable configurations.

Figure 5C:
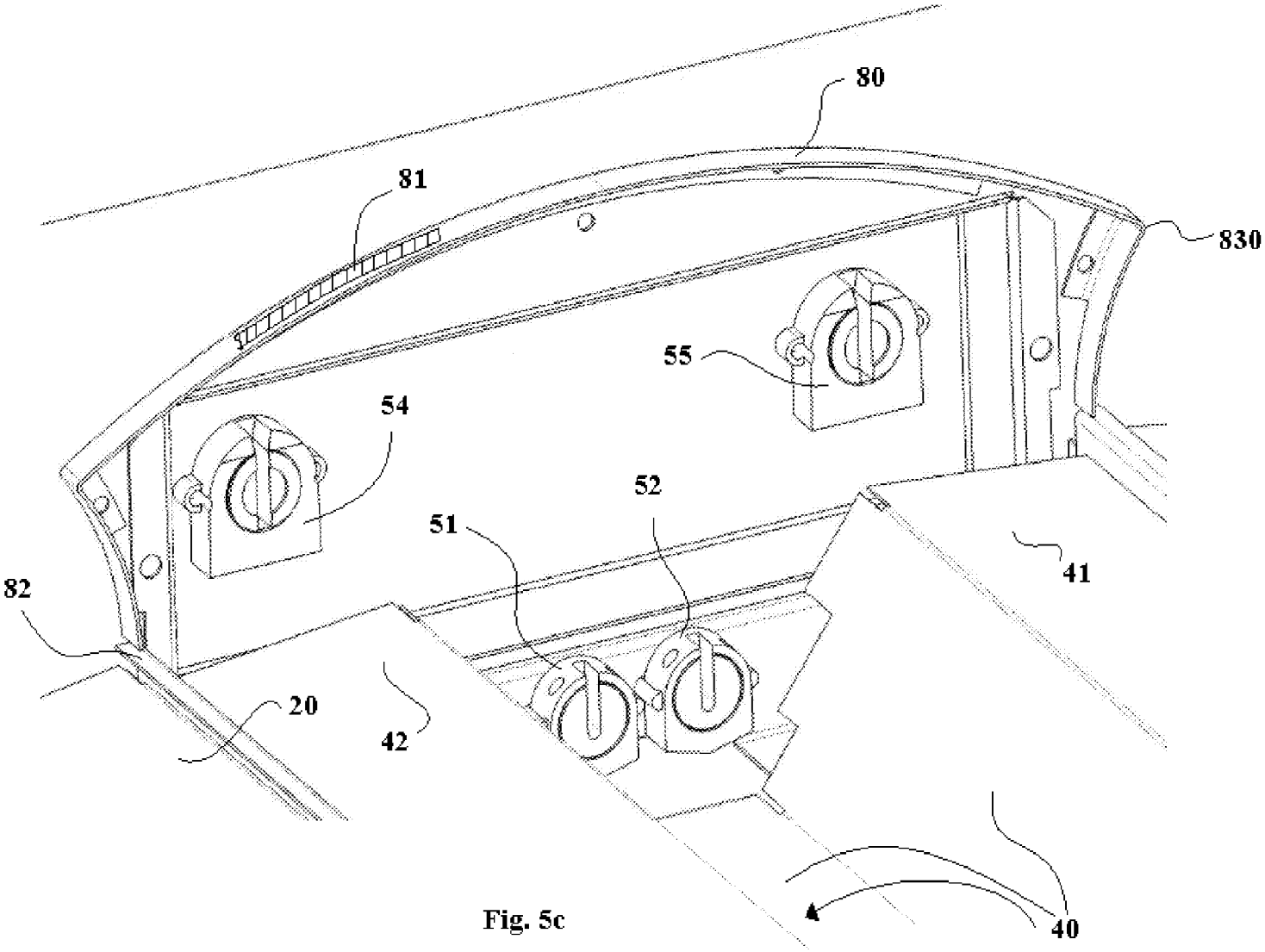
FIG. 5*c* is an illustration of an alternative embodiment of the light fixture depicted in FIG. 5*a*.

FIG. 5*c* illustrates an alternative embodiment of the light fixture depicted in FIG. 5*a*. As can be appreciated, the bracket 80 is configured to extend down to the rail 82. As in FIG. 5*a*, the seal 81 is shown only extending along a portion of the bracket 80, however the seal 81 may extend along the entire length of bracket 80 if desired.

Referring again to FIG. 1, the invention includes a lens or diffuser 700. The diffuser 700 is preferably made of a DR high impact plastic or acrylic material, with a 50% DF diffuse material blend so that the diffuser 700 has an opaque or frosted appearance. Preferably the diffuser 700 is integrally formed as a single, solid but flexible piece of extruded acrylic. Typically, increasing the distance between the diffuser 700 and the bulbs in the fixture provides for an improved light distribution performance. However, if the diffuser is to avoid extending beyond the mounting surface, the limit of such a distance is based on the light fixture depth and, potentially, the depth that a light fixture could be inserted into a mounting surface.

Figure 6:
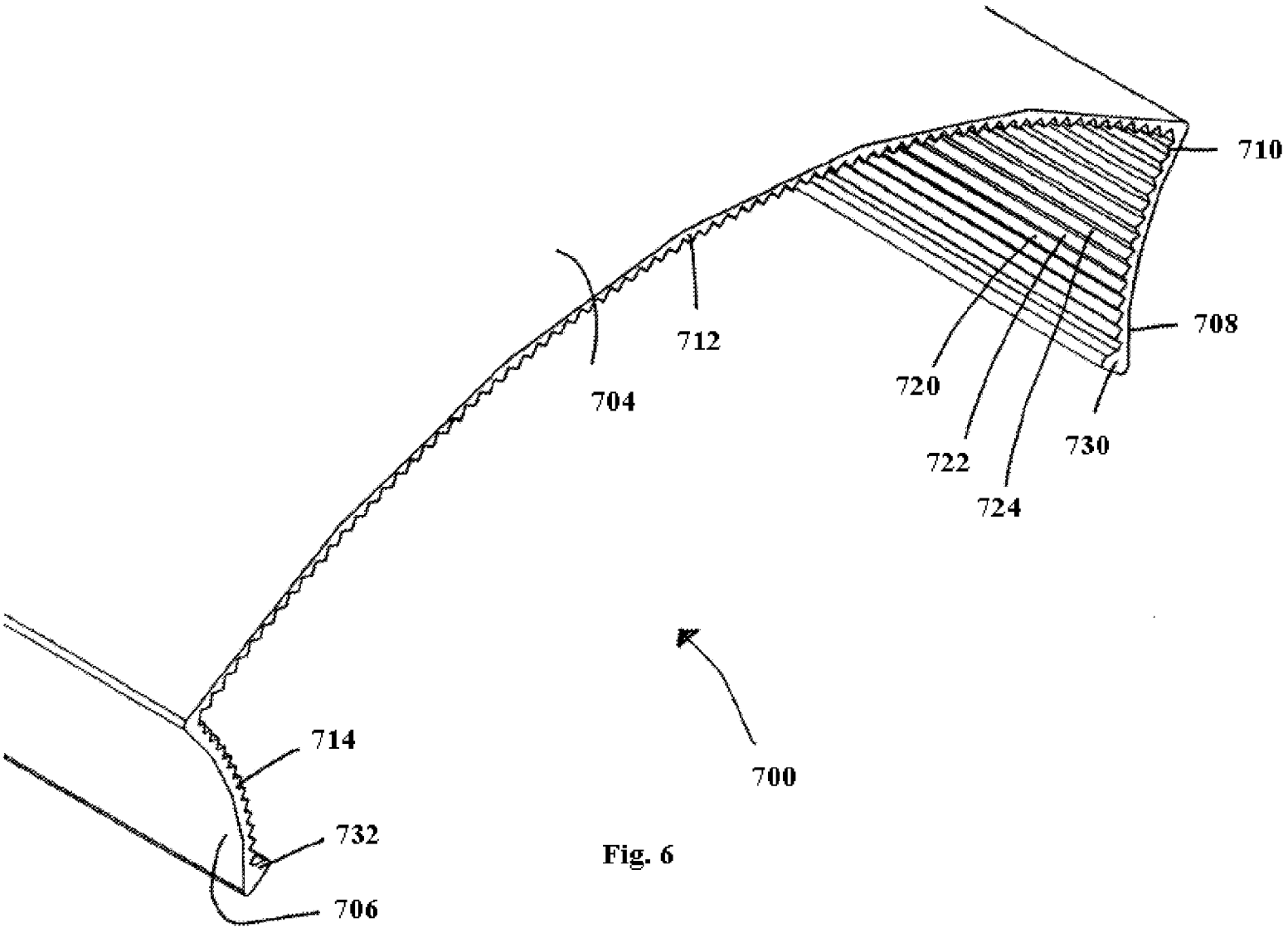
FIG. 6 is an illustration of an isometric view of the diffuser shown in FIG. 1.
Figure 7:
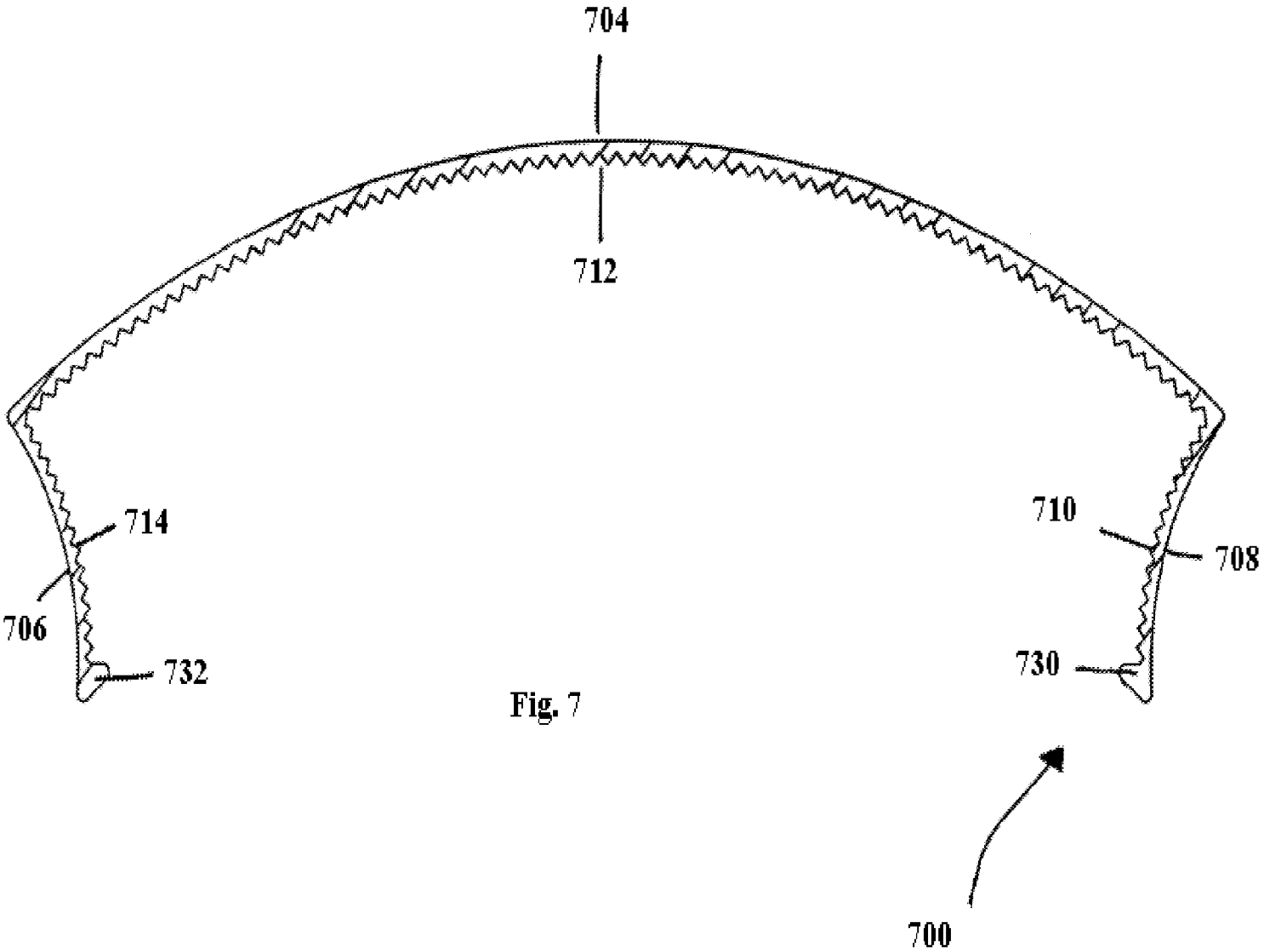
FIG. 7 is an illustration of a side view of the diffuser shown in FIG. 6.

As shown in FIGS. 6 and 7, the diffuser 700 includes a curved outer upper surface 704, a curved outer side surface 706 and a second curved outer side surface 708. The outer surfaces 704, 706 and 708 may be smooth so that dust and contaminants do not accumulate on the surfaces and any dust on the exterior surfaces can be easily cleaned from the surfaces. The outer surfaces are a solid material that preferably does not include openings or perforations, thus preventing the passage of dust or other contaminants through the diffuser.

The diffuser 700 further includes interior surfaces 710, 712 and 714. As depicted, each of the interior surfaces 710, 712 and 714 include multiple linear prisms that extend the full longitudinal direction of the diffuser 700. For example, interior surface 710 includes linear prisms 720, 722 and 724. The linear prisms 720, 722 and 724 diffuse and distribute light from the light source more evenly and thus avoid the appearance of "hot spots," or focused light, emanating from the fixture. In certain settings, it may be preferable to position the linear prisms on the exterior surfaces 704, 706 and 708 for reasons relating to optics and light transmission. However, in a preferred embodiment, the linear prisms 720, 722 and 724, if used, are positioned on the interior surfaces 710, 712 and 714 so that the outer surface is smooth, such that dust and contaminants do no accumulate on the diffuser and so that the diffuser is easier to clean.

As shown in FIGS. 6 and 7, the surfaces 704, 706 and 708 of the diffuser 700 are curved. The curvature of outer surface 704 from the light source, while not required, adds depth between the light source and the diffuser 704, improving the optical and light transmission qualities of the fixture. The curvature of the outer surfaces 706, 708 provides desired transmission of light from the diffuser 700 to the structural reflector 20.

Figure 8:
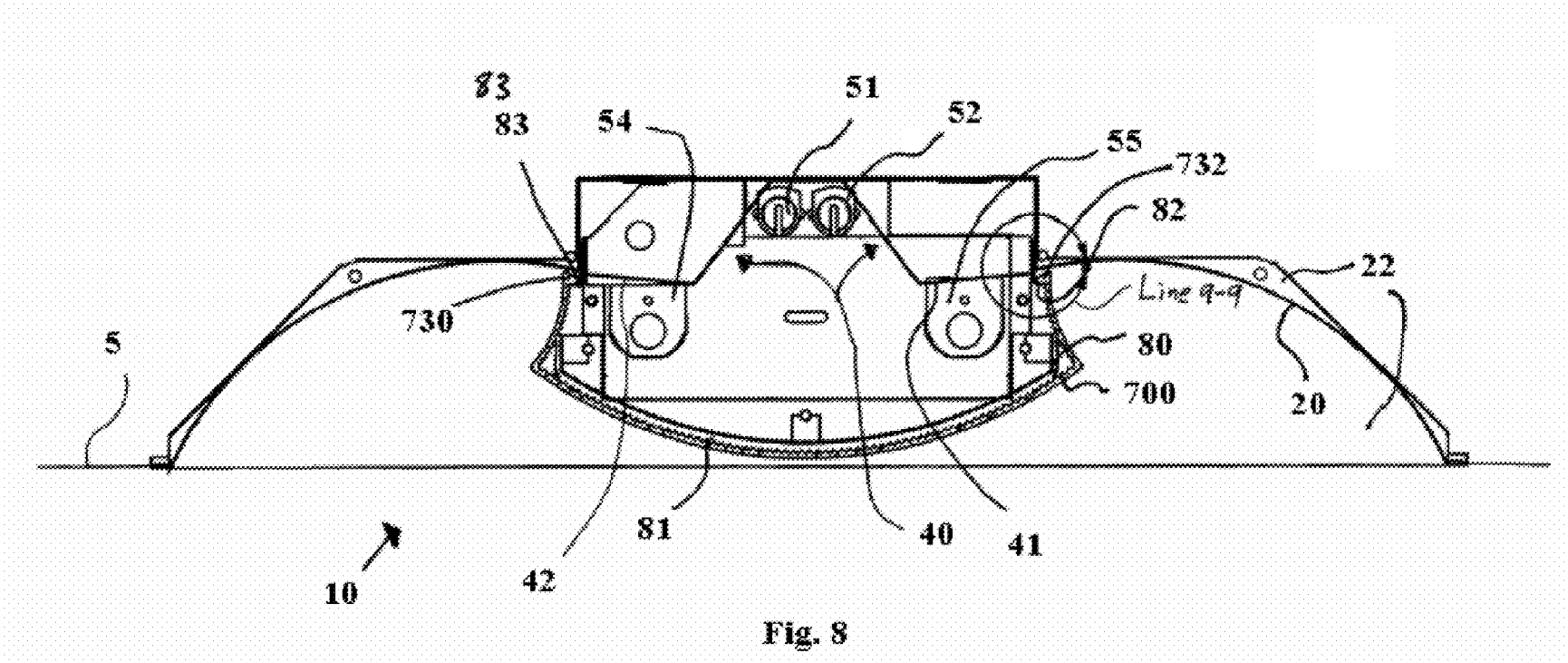
FIG. 8 is an illustration of a cross-section of an embodiment of the light fixture shown in FIG. 1 with the diffuser installed.

As depicted, the diffuser 700 includes a pair of lips 730, 732 that extend longitudinally along the entire length of the diffuser 700. As shown in FIGS. 8 and 20, the lip 730 flexibly engages a rail 82 that extends the entire longitudinal length of the light fixture 10.

Figure 9:
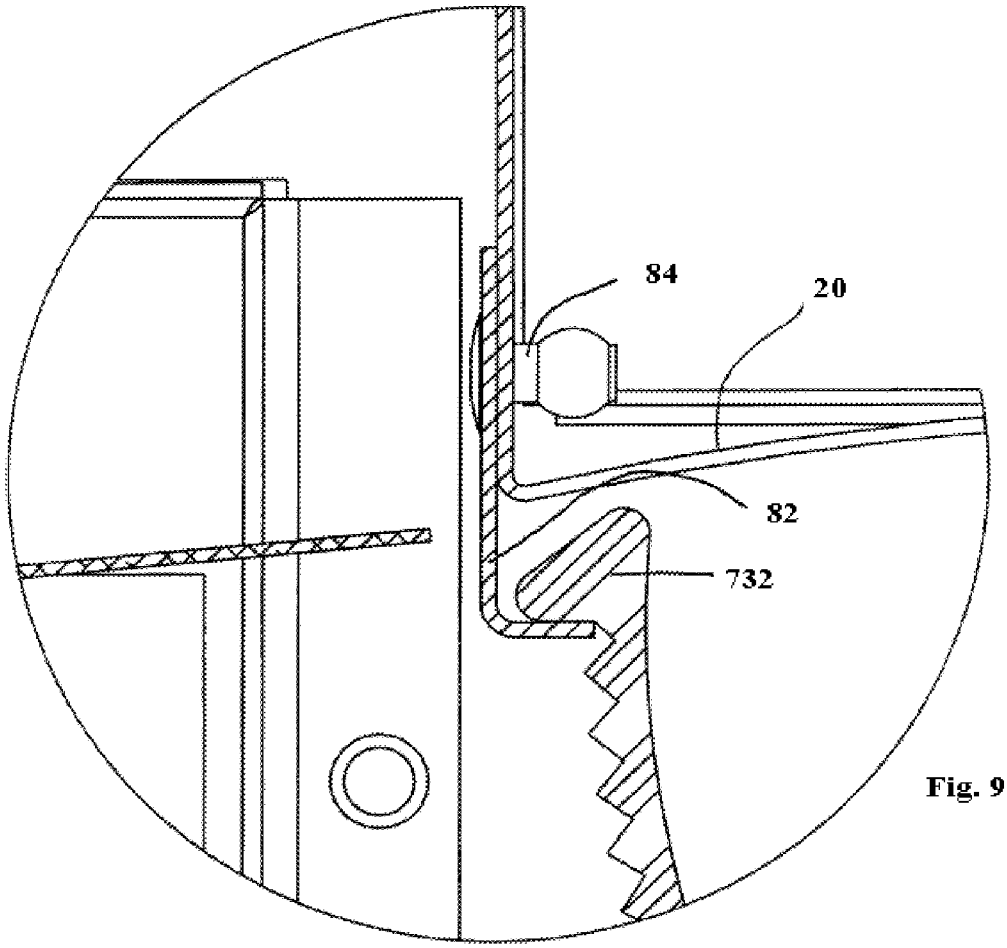
FIG. 9 is an illustration of a close-up cross-section of the light fixture of FIG. 8 along the line 9.

The diffuser 700 is preferably constructed of a flexible material so that it can be flexed and bent to engage the light fixture as described above without cracking. Further details of the engagement of the lip 732 with the rail 82 is shown in FIG. 9, discussed below.

The diffuser is sealed to the structural reflector fixture along the length of the structural reflector 20 so that the outer solid surfaces 704, 706 and 708, as well as the engagement of the lips 730, 732 with the rails 82, 83, help prevent the flow of air, dust and impurities onto the light source and the inner portion of the fixture.

FIG. 8 illustrates a cross-section of an exemplary embodiment of the sealed light fixture with the diffuser 700 installed and the light fixture 10 in the installed position (i.e. substantially flush with a mounting surface 5). Structural reflector 20 and end cap 22 provide the depicted enclosure such that the light fixture 10 can be recessed in a ceiling (not shown). As depicted, the lamp holders 51 and 52 are configured to accept T5 high output bulbs and the lamp holders 54 and 55 are configure to accept T8 bulbs. Lamp holders 51 and 52 are situated approximate the optics area 40 and lamp holders 54 and 55 are situated approximate optics areas 54 and 55, respectively.

The diffuser 700 sealably mounts to the rails 82 and 83 and the bracket 80. The gasket 81 provides a sealing function between bracket 80 and diffuser 700. When installed, the diffuser 700 compresses the gasket 81, thus the gasket 81 also aids in providing a sealing force along the interface between the rails 82 and 83 and the diffuser 700. Preferably, the gasket 81 is made of closed cell foam.

In an embodiment, the dimensions of the light fixture are 5.25 inches high by 24 inches wide by 48 inches long. As can be readily appreciated by one of skill in the art, depending on the diffuser, the light sources, and the geometry of the reflective surfaces, the width and height can be adjusted. Naturally, the length can also be adjusted to meet the requirements of the particular user; preferably the length is such that a standard light source can be used with the recessed light fixture (i.e. the fixture is configured to accept a light source that is 2 feet long, 4 feet long, etc . . . ).

In an exemplary embodiment, the light fixture 10 includes two modes, an ambient light mode and an examination mode. In an embodiment, providing power to the light fixture activates the ambient light mode, which provides power to the two T8 bulbs so as to provide a moderate light level on the surface below the light fixture. When the fixture is switched to examination mode, electrical power is additionally supplied to the two T5 high output bulbs, so that all four bulbs are illuminated. This substantially increases the level of light illuminating the surface below the light fixture so as to aid an individual examining a patient. Preferably, the area of increased illumination covers the majority of a patient situated below the light fixture.

In an exemplary embodiment using two T8 bulbs and two T5 high output bulbs, during ambient mode (which activates the two T8 bulbs) a 4 feet by 2 feet recessed light fixture provides between 35 and 43 foot-candles of illumination on a 4 feet by 2 feet area about 60 inches below the light fixture. When switched to examination mode (which activates all four bulbs), the same exemplary embodiment provides between 99 and 122 foot-candles of illumination on the same area at the same distance. As can be appreciated, the transition between ambient mode and examination mode could be accomplished more gradually via a known dimmer switch. Over time it is expected that the light output would gradually decrease depending on various environmental facts.

As can further be appreciated, the illumination over the entire length of the patient lying beneath the light fixture would be affected by a change between ambient and examination mode, however it is expected that the light level would tend to decrease as the distance from the light fixture increased. Positioning the light fixture over the expected center of the patient is expected to provide the most even light distribution, however it may be desirable to bias the placement of the light fixture so as to provide the maximum light where it is desired. Thus, a foot specialist might want to bias the light toward the patient's feet while an ear, nose and throat specialist might want to bias the light towards the patient's head.

FIG. 9 illustrate a close-up of FIG. 8 along the line 9. Rail 82 is depicted mounted to the structural reflector 20 via a fastener 84, which may be a screw or rivet or other known fastening devices include a spot weld. As depicted, lip 732 engages rail 82 so as to provide a seal between the internal portion, such as the light sources located within the fixture, and the external environment. Thus dust and bacteria accumulation inside the fixture is minimized.

Figure 10A:
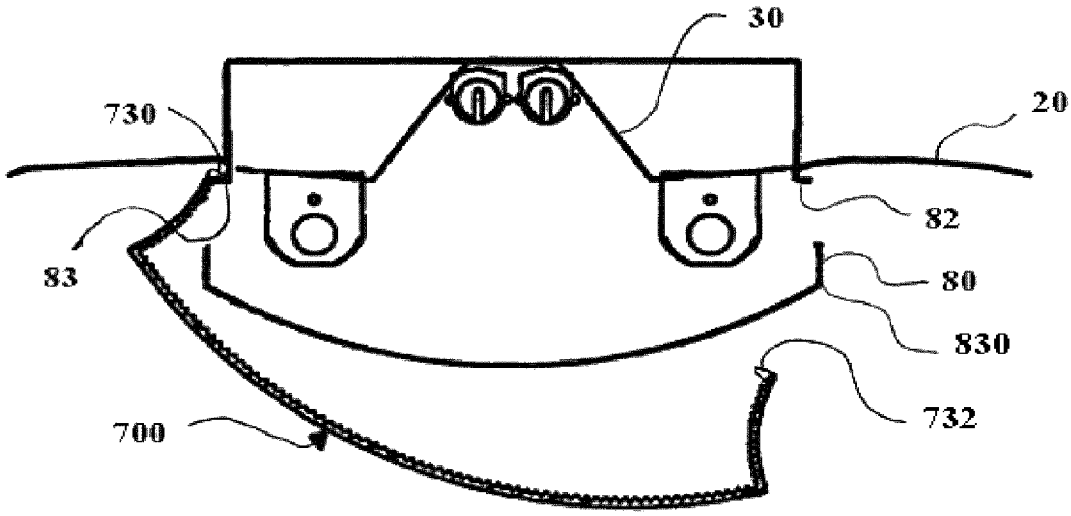
FIG. 10*a* is an illustration of a partial cross-sectional view of an exemplary embodiment with the diffuser being installed.

FIG. 10*a* depicts a partial cross-sectional view of an exemplary embodiment with the diffuser about to be installed. The diffuser 700 is attached to the housing 11 (not shown) in the following manner. First the one side, for example, the lip 730 of the diffuser 700 is attached to the rail 83.

Figure 10B:
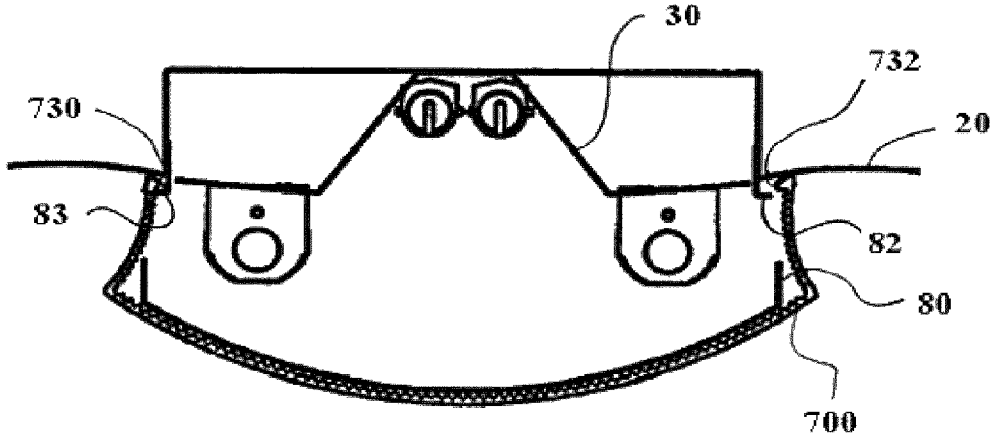
FIG. 10*b* is an illustration of the embodiment depicted in FIG. 10*a* with the diffuser near the installed position.

Next, as depicted in FIG. 10*b*, the diffuser is rotated upward toward the bracket 80 and side 706 is flexed so that the lip 732 clears a bracket 80, including a bracket corner 830. Once the diffuser 700 is pushed upward past the bracket corner 830 and is aligned with rail 82, the force flexing the diffuser can be relaxed so that the lip 732 engages the rail 82.

Figure 11:
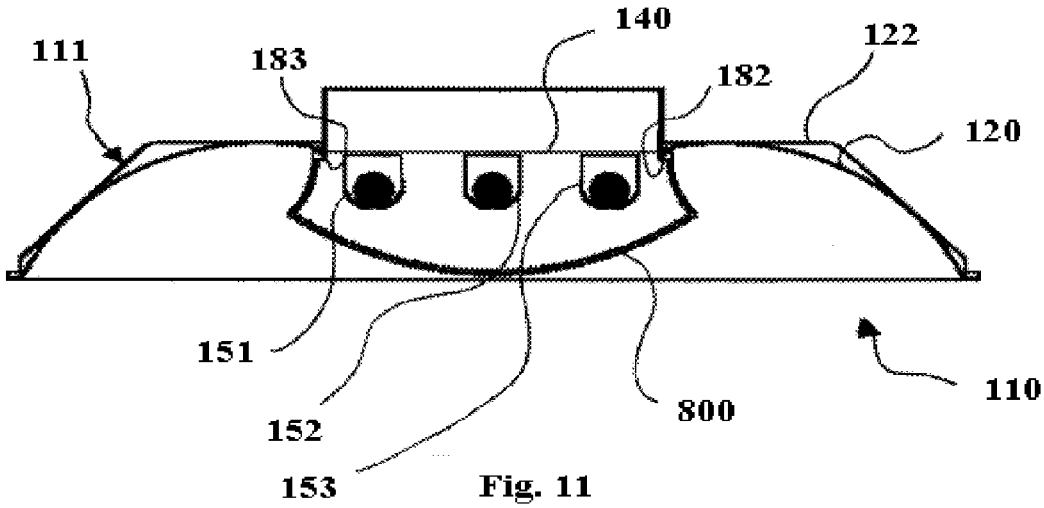
FIG. 11 is an illustration of a partial cross-section of an exemplary embodiment of the light fixture showing the light sources installed.

A partial cross-sectional view of an alternative embodiment of a light fixture 110 is depicted in FIG. 11. As depicted, the light fixture includes a structural reflector 120, an end cap 122, an end cap 123 (not shown), and a diffuser 800. The light fixture housing 111 includes the structural reflector 120, the end cap 122 and the end cap 123; these components may be assembled in a manner similar to the above described light fixture housing 11.

As depicted, the light fixture 110 includes an optics area 140. Lamp holders 151, 152 and 153 are mounted approximate the optics area 140 and are configured to accept light sources such as a T8 bulb. As depicted, a rail 182 and a rail 183 extends along both sides of an optics area 140. Thus, the diffuser 800 is configured to mount to the rails in a manner similar to that discussed above. A bracket and gasket, not shown, may be advantageously used to seal a portion of the ends of the diffuser 800 to the light fixture housing 111 in a manner similar to the bracket and gasket depicted in FIG. 5. In such an embodiment, the gasket between the bracket and the diffuser 800 further reduce the accumulation of dust and bacteria on the interior components of the light fixture.

In operation, power may be provided to all three bulbs receptors at the same time. Preferably all lamp holders are configured to accept the same type of bulb so that when a series of the light fixtures are installed along a hallway, for example, the light fixtures provide an attractive and relatively even light distribution that is easily maintained. The light fixtures can also be configured to have one or more modes of illumination; however, the cost of the fixture may be reduced if the light fixture is configured to provide a single mode of operation. Furthermore, in a hallway there may be less need for variations in light output.

Figure 12:
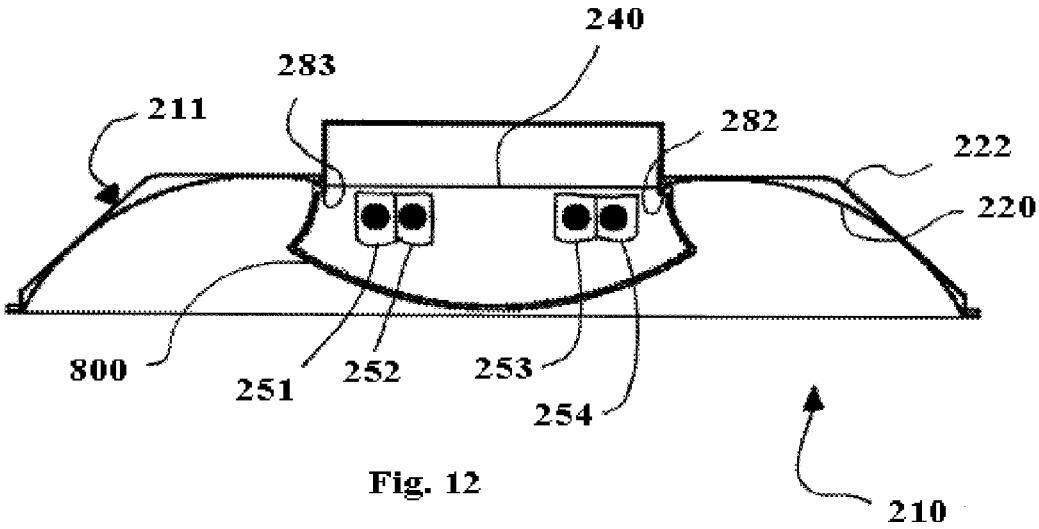
FIG. 12 is an illustration of a partial cross-section of another embodiment of the light fixture showing the light sources installed.

FIG. 12 is a cross-sectional view of an alternative embodiment of the light fixture. As depicted, a light fixture 210 is configured in a manner similar to the light fixture discussed in FIG. 11. A structural reflector 220 is combined with an end cap 222 to form a fixture housing 211. Another end cap, not shown will typically be mounted opposite the end cap 222. A diffuser 800 is mounted to rails 283 and 282 so as to seal the internal components of the light fixture and reduce the accumulation of dust and bacteria inside the light fixture. Furthermore, in an embodiment the smooth exterior surface of a diffuser 800 reduces the tendency of dust to accumulate on the exterior surface of the diffuser. The light fixture 210 includes lamp holders 251, 252, 253, and 254, with the lamp holders configured so that four bulbs can be installed approximate the optics area 240. Naturally, the number of bulbs used should correlate to the desired light output and the light level provided by each bulb used. Thus, when using a bulb with a higher level of light output, fewer bulbs would be needed to provide similar levels of illumination.

While described in terms of mounting the fixture on the ceiling, it should be understood that the recessed light could also be mounted on a different surface such as a wall if so desired.

The present invention has been described in terms of preferred and exemplary embodiments thereof. Numerous other embodiments, modifications and variations within the scope and spirit of the appended claims will occur to persons of ordinary skill in the art from a review of this disclosure.

We claim:

1. A recessed light fixture, comprising:

a light fixture housing, the housing comprising a first optics area and a second optics area, the housing having a first curved reflector portion with an outer edge and a second curved reflector portion with an outer edge, wherein the first optics area includes three sides that form a channel along the longitudinal centerline of the light fixture and where the second optics area is separate from the first optics area;

a first rail and a second rail mounted on the housing;

a first light source type providing downlight and mounted on the housing between the first and second rails, the first light source type having a first illumination level;

a first pair of lamp holders mounted approximate the first optics area, the first pair of lamp holders configured to accept the first light source type having the first level of illumination;

a second pair of lamp holders mounted approximate the second optics area, the second pair of lamp holders configured to accept the second light source type having the second level of illumination lower than the first level of illumination; and a diffuser mounted on the housing.

2. The recessed light fixture of claim 1, wherein the diffuser comprises a plurality of linear prisms on an interior surface.

3. The recessed light fixture of claim 1, wherein the first light source type comprises a plurality of light bulbs and the second light source type comprises a plurality of light bulbs.

4. The recessed light fixture of claim 1, wherein the first mode activates the first light source type and a second mode activates the first light source type and the second light source type.

5. The recessed light fixture of claim 1, wherein the first and second light source types are each mounted on the housing via at least one pair of lamp holders.

6. A recessed fixture for use on a mounting surface, comprising:

a housing configured to be installed with the mounting surface, the housing comprising a first optics area and a second optics area, the housing having a first curved reflector portion with an outer edge and a second curved reflector portion with an outer edge, wherein the first optics area includes three sides that form a channel along the longitudinal centerline of the light fixture and where the second optics area is separate from the first optics area;

a pair of brackets mounted to the housing and positioned on opposing ends of the housing;

a pair of rails mounted to the housing and positioned between the outer edges of the first and second curved reflector portions;

a first pair of lamp holders mounted approximate the first optics area, the first pair of lamp holders configured to accept a first light source type having a first level of illumination;

a second pair of lamp holders mounted approximate the second optics area, the second pair of lamp holders configured to accept a second light source type having a second level of illumination substantially lower than the first level of illumination; and a diffuser mounted to the pair of rails, the diffuser having a length, an interior side and an exterior side.

7. The recessed light fixture of claim 6, wherein the first mode of operation is an ambient light mode and the second mode of operation is an examination mode.

8. The recessed light fixture of claim 6, wherein the housing comprises a third optics area and a third par of lamp holders is mounted approximate the third optics area, the third lamp holder configured to accept the second light source type.

9. The recessed light of claim 8, comprising a fourth pair of lamp holders, the fourth pair of lamp holders mounted approximate the first optics area, the fourth pair of lamp holders being configured to accept the first type of light source.

10. The recessed light fixture of claim 9, wherein the first mode of operation provides electrical power to the second and third pair of lamp holders.

11. The recessed light fixture of claim 9, wherein the second mode of operation provides electrical power to the first, the second, the third, and the fourth pair of lamp holders.

12. The recessed light fixture of claim 6, wherein the exterior side of the diffuser is substantially smooth and the mounting surface is a ceiling.

13. The recessed light fixture of claim 6, wherein the diffuser includes a plurality of linear prisms extending the length of the diffuser.

14. The recessed light fixture of claim 13, wherein the plurality of linear prisms is located on the interior side of the diffuser and the exterior side of the diffuser is substantially smooth.

15. A recessed light fixture, comprising:

a housing configured to mount to a mounting surface, the housing comprising:

a single-piece structural reflector having a first end and second end and a first side and second side, the structural reflector including a first curved portion on the first side, a second curved portion on the second side, and a rectangular portion extending between the first and second curved portion on the second side, and a rectangular portion extending between the first and second curved portions, the housing comprising a first optics area and a second optics area, wherein the first optics area includes three sides that form a channel along the longitudinal centerline of the light fixture and where the second optics area is separate from the first optics area;

a first end cap fastened to the first end of the structural reflector; and a second end cap fastened to the second end of the structural reflector;

a plurality of lamp holders mounted on the housing, the lamp holders configured to accept a plurality of light sources, the plurality of lamp holders comprising:

a first pair of lamp holders mounted approximate the first optics area, the first pair of lamp holders configured to accept a first light source type having a first level of illumination;

a second pair of lamp holders mounted approximate the second optics area, the second pair of lamp holders configured to accept a second light source type having a second level of illumination lower than the first level of illumination; and a diffuser configured to mount on the housing.

16. The recessed light fixture of claim 15, wherein the first and second end cap are welded to the structural reflector and wherein the first and second curved portions include an outer edge and the diffuser is configured to not extend beyond a line drawn between the outer edges.

17. The recessed light fixture of claim 16, further comprising a first rail mounted approximate the rectangular portion on the first side, the first rail being positioned substantially between the rectangular portion and the first curved portion and a second rail mounted approximate the rectangular portion on the second side, the second rail being positioned substantially between the rectangular portion and the second curved portion, wherein the diffuser comprises a first lip and second lip, whereby the first and second lips sealably mount to the first and second rails, respectively, so as to substantially seal the diffuser to the structural reflector.

18. The recessed light fixture of claim 17, further comprising a first bracket mounted on the first end cap, and a second bracket mounted on the second end cap, wherein the first bracket includes a first seal, and the second bracket includes a second seal, wherein the first bracket and first seal are configured to substantially seal the first end of the diffuser to the structural reflector and the second bracket and the second seal are configured to substantially seal the second end of the diffuser to the structural reflector.

19. The recessed light fixture of claim 17, further comprising a first gasket mounted on the first end cap and a second gasket mounted on the second end cap, the first gasket configured to substantially seal the first end of the diffuser to the structural reflector, the second gasket configured to substantially seal the second end of the diffuser to the structural reflector.

20. The recessed light fixture of claim 19, wherein the first gasket includes at least one finger, the finger configured to substantially link the first gasket and the rail.

21. The recessed light fixture of claim 1, wherein the light fixture housing includes a structural reflector, a first end cap, and a second end cap, wherein the end caps are welded to the structural reflector and positioned on opposing ends of the structure reflector.

22. A recessed light fixture for sue on a mounting surface, comprising:

a housing configured to be installed with the mounting surface, the housing having a structural reflector, a first end cap, and a second end cap, wherein the end caps are attached to the structural reflector and positioned on opposing ends of the structural reflector, wherein the structural reflector has a first curved side, a rectangular portion, and a second curved side;

an optical reflector attached to the rectangular portion of the structural reflector and positioned along the longitudinal centerline of the light fixture, the optical reflector having a first optics area and a second optics area, wherein the first optics area includes three sides that form a channel along the longitudinal centerline of the light fixture and where the second optics area is separate from the first optics area;

a pair of brackets mounted on the end caps and positioned on opposing ends of the housing;

a pair of rails mounted to the housing and positioned between the outer edges of the first and second curved reflector portions;

a first pair of lamp holders mounted approximate the first optics area, the first pair of lamp holders configured to accept a first light source type having a first level of illumination;

a second pair of lamp holders mounted approximate the second optics area, the second illumination substantially lower than the first level of illumination; and a diffuser mounted to the pair of rails, wherein the fixture, in operation, is switchable between a first mode of operation and a second mode of operation.

* * * * *